United States Patent [19]

Land et al.

[11] 4,298,674

[45] Nov. 3, 1981

[54] COLOR TRANSFER FILM AND PROCESS

[75] Inventors: Edwin H. Land, Cambridge; Leon D. Cerankowski, Carlisle; Neil Mattucci, Billerica, all of Mass.

[73] Assignee: Polaroid Corporation, Cambridge, Mass.

[21] Appl. No.: 143,293

[22] Filed: Apr. 24, 1980

Related U.S. Application Data

[63] Continuation-in-part of Ser. No. 33,001, Apr. 24, 1979, abandoned.

[51] Int. Cl.[3] ..... G03C 5/54

[52] U.S. Cl. ..... 430/213; 430/215; 430/220; 430/221; 430/238; 428/484

[58] Field of Search ..... 430/213, 214, 215, 216, 430/227, 236, 221, 237, 244, 238; 428/484, 500, 522, 515, 520

[56] References Cited

U.S. PATENT DOCUMENTS

| | | | |
|---|---|---|---|
| 3,698,896 | 10/1972 | Abbott | 430/213 |
| 3,706,557 | 12/1972 | Arond | 430/215 |
| 3,734,727 | 5/1973 | Milligan | 430/216 |
| 3,778,265 | 12/1973 | Land | 430/213 |
| 3,930,864 | 1/1976 | Abel et al. | 430/213 |
| 4,190,447 | 2/1980 | Coil et al. | 430/215 |

*Primary Examiner*—J. Travis Brown

*Attorney, Agent, or Firm*—Stanley H. Mervis

[57] ABSTRACT

Diffusion transfer films and processes are disclosed wherein the processing composition includes a light-reflecting pigment and a pH-sensitive optical filter agent, and the image-receiving element carries a layer containing a substantially non-diffusible agent adapted to decolorize optical filter agent immediately adjacent the interface between said processing composition and said layer containing said decolorizing agent.

69 Claims, 1 Drawing Figure

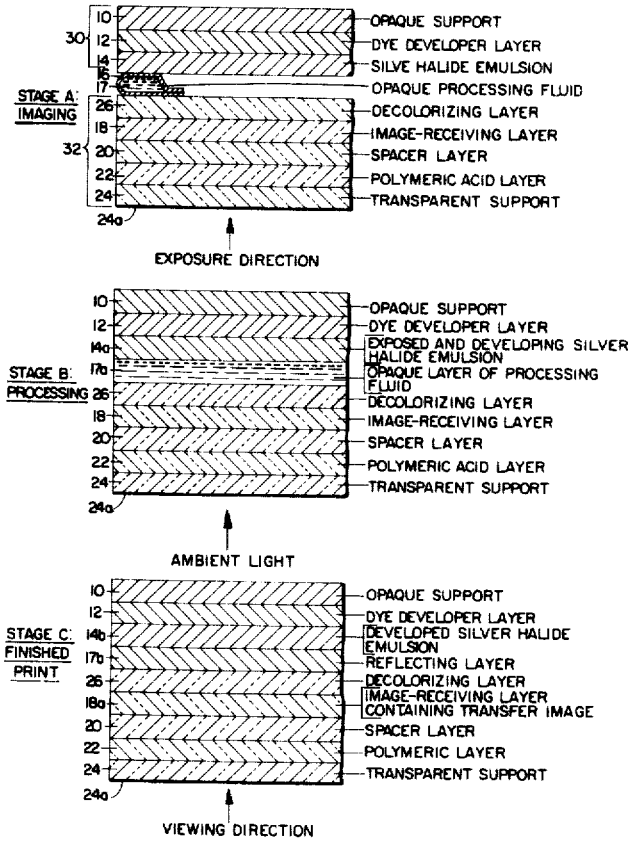

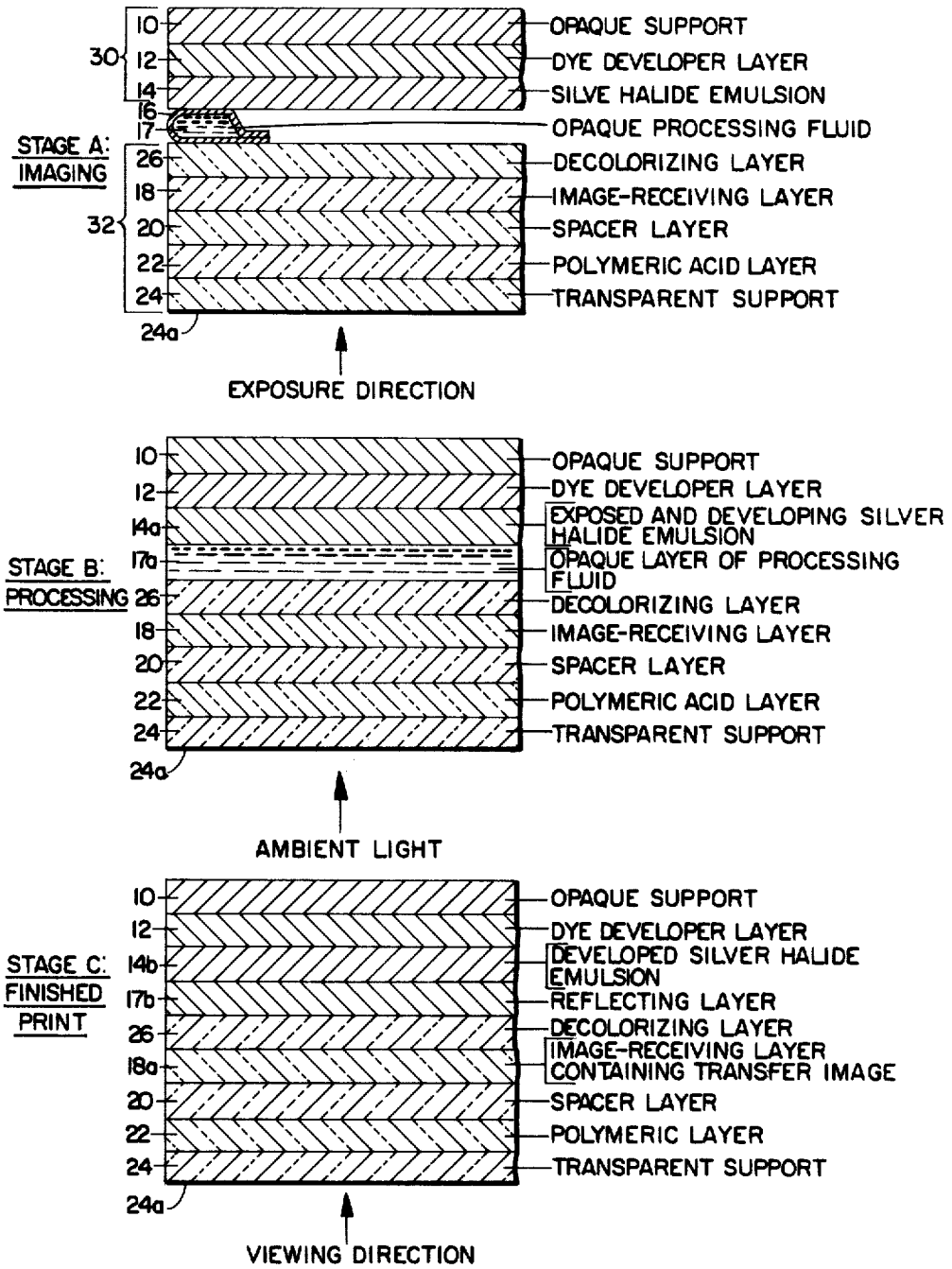
STAGE A: IMAGING
30
32
10
12
14
16
17
26
18
20
22
24
24a
OPAQUE SUPPORT
DYE DEVELOPER LAYER
SILVE HALIDE EMULSION
OPAQUE PROCESSING FLUID
DECOLORIZING LAYER
IMAGE-RECEIVING LAYER
SPACER LAYER
POLYMERIC ACID LAYER
TRANSPARENT SUPPORT
EXPOSURE DIRECTION
STAGE B: PROCESSING
10
12
14a
17a
26
18
20
22
24
24a
OPAQUE SUPPORT
DYE DEVELOPER LAYER
EXPOSED AND DEVELOPING SILVER HALIDE EMULSION
OPAQUE LAYER OF PROCESSING FLUID
DECOLORIZING LAYER
IMAGE-RECEIVING LAYER
SPACER LAYER
POLYMERIC ACID LAYER
TRANSPARENT SUPPORT
AMBIENT LIGHT
STAGE C: FINISHED PRINT
10
12
14b
17b
26
18a
20
22
24
24a
OPAQUE SUPPORT
DYE DEVELOPER LAYER
DEVELOPED SILVER HALIDE EMULSION
REFLECTING LAYER
DECOLORIZING LAYER
IMAGE-RECEIVING LAYER CONTAINING TRANSFER IMAGE
SPACER LAYER
POLYMERIC LAYER
TRANSPARENT SUPPORT
VIEWING DIRECTION

COLOR TRANSFER FILM AND PROCESS

This application is a continuation-in-part of copending application, Ser. No. 033,001 filed on Apr. 24, 1979 (now abandoned).

This invention is concerned with photography and, more particularly, with photographic processes which are conducted outside of the camera in which the film is exposed.

U.S. Pat. No. 3,415,644 issued Dec. 10, 1968 to Edwin H. Land discloses photographic products and processes wherein a photosensitive element and an image-receiving element are maintained in fixed relationship prior to exposure, and this relationship is maintained as a laminate after processing and image formation. In these products and processes, the final image is viewed through a transparent (support) element against a reflecting, i.e., white, background. Photoexposure is made through said transparent element and application of the processing composition provides a layer of light-reflecting material to provide a white background for viewing the final image through said transparent support. The light-reflecting material (referred to in said patent as an "opacifying agent") is preferably titanium dioxide, and it also performs an opacifying function, i.e., it is effective to mask the developed silver halide emulsions so that the transfer image may be viewed without interference therefrom, and it also helps to protect the photoexposed silver halide emulsions from post-exposure fogging by light passing through said transparent layer if the photoexposed film unit is removed from the camera before image-formation is completed.

U.S. Pat. No. 3,647,437, issued Mar. 7, 1972 to Edwin H. Land, discloses photographic products which may be processed outside of the camera in which the film is exposed, fogging of the film by ambient light being prevented by provision of one or more opacifying dyes, sometimes referred to as light-absorbing optical filter agents, appropriately positioned in the film unit after photoexposure. In a particularly useful embodiment of that invention, the film unit is a film unit of the type described in the aforementioned U.S. Patent No. 3,415,644 and comprises first and second sheet-like elements, the first sheet-like element comprising an opaque base carrying a silver halide emulsion, and the second sheet-like element comprising a transparent support carrying an image layer, i.e., a layer adapted to receive an imagewise distribution of an image-forming material initially present in said first sheet-like element. After photoexposure a processing composition, adapted to develop the exposed silver halide emulsion and to form the desired image in said image layer, is distributed in a thin layer between said sheet-like elements. The processing composition contains a light-reflecting pigment, such as titanium dioxide, and at least one light-absorbing optical filter agent, such as a pH-sensitive phthalein dye which is colored at the initial pH of said processing composition. As disclosed in said U.S. Pat. No. 3,647,437, the concentrations of said light-reflecting pigment and said optical filter agent(s) are such that the layer of processing composition is sufficiently opaque to light actinic to the silver halide emulsion that the film unit may be ejected from the camera immediately after the processing composition is distributed, notwithstanding the fact that the second sheet-like element will transmit light incident on the surface thereof. This opacification system is quite effective and is employed in Polaroid Land SX-70 film. The light-absorbing capacity of the optical filter agent is discharged after this ability is no longer needed, so that the optical filter agent need not be removed from the film unit. Where the optical filter agent is a pH-sensitive dye, such as a phthalein indicator dye, it may be discharged or decolorized by reducing the pH after a predetermined time, e.g., by making available an acid-reacting material such as a polymeric acid.

In the preferred embodiments of the opacification system described in U.S. Pat. No. 3,647,437 the concentrations of the light-reflecting pigment and light-absorbing optical filter agent in the layer of processing composition will be such that that layer will have a transmission density of at least about 6 but a reflection density not greater than about 1. The presence of a long chain substituent, e.g., a long chain alkoxy group, on the optical filter agent is useful in reducing its diffusibility so that diffusion to the image-receiving layer is minimized.

A reflection density of about 1 will be recognized as very small compared with a transmission density of 6 or more for the same layer. In practice it has been possible to use a concentration of optical filter agents and titanium dioxide such that the reflection density of the processing composition layer, as measured about 30 seconds after distribution, is much lower than 1, e.g., about 0.5 to 0.6. While transferring dye and the emerging dye image may be seen at opacification system reflection densities of about 0.5, the presence of such temporary coloration of the highlight or white areas of the image, and the temporary distortion of the colors of the already transferring image dyes, is aesthetically undesirable.

As noted above, where the optical filter agent is a pH-sensitive dye, it is "discharged", i.e., rendered substantially colorless, by a reduction of the pH of the strata containing the optical filter agent. These strata include the light-reflecting pigment layer, provided by the processing composition, as well as the image-receiving layer and any other layers between the light-reflecting pigment layer and the transparent support through which the final image is viewed. This pH reduction is effected, to a pH level below the pKa of the optical filter agent, after a predetermined time. This delay is necessary in order that silver halide development be substantially completed before incident light is transmitted to the developing silver halide emulsions. Since the image dyes are preferably soluble and diffusible at the initial pH of the process but substantially nondiffusible at a lower pH, reduction of the pH to the appropriate lower pH after a predetermined period serves the very important function of controlling unwanted continued transfer of image dyes after the desired dye image has been formed.

It will be recognized that these desired results of pH reduction are only partly compatible, for early pH reduction to provide a white background early in the process could prematurely stop transfer of image dyes, resulting in a pale, i.e., low density, image which may also have an unbalanced color balance.

It has been recognized, e.g., in FIG. 8 of U.S. Pat. No. 3,778,265, issued Dec. 11, 1973 to Edwin H. Land, that the opacification system may be considered to be "visually clear", i.e., the background provided by the titanium dioxide layer to be substantially white to the eye, when the reflection density, particularly the red reflection density, was reduced to about 0.3. In the particular system represented by said FIG. 8, the initial reflection density was between 0.5 and 0.6 and this reduction to about 0.3 reflection density to give "visual clearing" occurred between 5 and 6 minutes after distribution of the processing composition. pH reduction in the just described example was effected by a neutral polymer adapted to interact with the alkaline composition, e.g., by hydrolysis, to reduce the pH. In the specific system of FIG. 8, the image-receiving layer comprised poly-4-vinylpyridine (mordant) in cellulose acetate (hydrolyzable neutral polymer).

U.S. Pat. No. 3,734,727, issued May 22, 1973 to Terry W. Milligan, proposed to reduce the first pH, after a predetermined period to insure that fogging does not occur, to a second pH at which the opacifying dyes are decolorized but the image dyes still are diffusible, and this second, intermediate pH is maintained for a second predetermined period of time to insure that desired dye transfer is effected before the pH is reduced to a still lower pH at which transfer of the image dyes is inhibited. Maintenance of the second or intermediate pH level is effected by providing a buffered pH. The desired reduction of the buffered pH, however, may take an undesirably long time. Moreover, this system contemplates discharging substantially all of the opacifying dye.

It is an object of this invention to provide diffusion transfer products and processes of the foregoing type where the background appears substantially white to the viewer, substantially immediately after the processing composition is applied while retaining opacification.

It is a further object of this invention to provide diffusion transfer products and processes employing an opacification system employing a pH-sensitive optical filter agent, wherein the optical filter agent immediately adjacent the interface between the processing composition layer containing the optical filter agent and the layer of the image-receiving component to which said composition is applied is decolorized, thereby reducing the reflection density of said layer while simultaneously maintaining the transmission density thereof.

Yet another object of this invention is to provide image-receiving elements useful in such products and processes and having an optical filter agent decolorizing layer over the image-receiving layer.

Other objects of the invention will in part be obvious and will in part appear hereinafter.

The invention accordingly comprises the several steps and the relation and order of one or more of such steps with respect to each of the others, and the product possessing the features, properties and relation of elements which are exemplified in the following detailed disclosure, and the scope of the application of which will be indicated in the claims.

For a fuller understanding of the nature and objects of the invention, reference should be had to the following detailed description, taken in conjunction with the accompanying drawing, wherein:

The FIGURE is a diagrammatic enlarged cross-sectional view of a film unit embodying the invention, illustrating the arrangement of layers during the three illustrated stages of a monochrome diffusion transfer process, i.e., exposure, processing and finished print.

In accordance with this invention, it has been found that it is possible to significantly reduce the reflection density provided by the layer of processing composition containing the light-reflecting pigment and the pH-sensitive optical filter agent without significantly reducing the transmission density thereof. This highly desirable improvement is obtained by decolorizing, substantially immediately after application of the processing composition, the optical filter agent immediately adjacent the interface between the processing composition and the layer of the second sheet-like element in contact with the processing composition. It is only necessary to decolorize a very small fraction of the applied optical filter agent in order to effectively render the interface substantially "white" when viewed by reflection. Since the reflection density is the result of light being absorbed twice by a given quantity of dye—once when the light enters and a second time when it is reflected back—it will be seen that decolorization of even a few molecules of dye adjacent the interface provides an effect which is so amplified by the optics of reflection that one can substantially lower the reflection density and increase the apparent whiteness of the layer of the processing composition providing the background against which the image is viewed without reducing the transmision density of the "white" layer to any significant extent.

As will be described in more detail hereinafter, in the preferred embodiments of this invention a "decolorizing" layer is provided between the image-receiving layer and the layer of processing composition. This decolorizing layer comprises a substantially nondiffusible agent adapted to decolorize the small concentration of optical filter agent which is present immediately adjacent the interface between the processing composition and the decolorizing layer. It is an important feature of this invention that this decolorizing is essentially limited to the optical filter agent which is present immediately adjacent the interface between the decolorizing layer and the processing composition. It is a feature of this invention that even though the decolorizing layer is relatively thin it inhibits diffusion of optical filter agent into the image-receiving layer where it may react with the mordant to form a "new species" whose color is discharged only at a lower pH; e.g., the new species exhibits a much lower pKa and remains colored until the pH is reduced to a much lower level than otherwise would be required for decolorization. It is a further feature of this invention that the remaining optical filter agent may be, and preferably is, discharged or decolorized by a subsequent pH reduction.

As indicated above, this invention is primarily directed to photographic processes wherein the desired image is obtained by processing an exposed photosensitive silver halide material, with a processing composition distributed between two sheet-like elements, one of said elements including said photosensitive material. The processing composition is so applied and confined within and between the two sheet-like elements as not to contact or wet outer surfaces of the superposed elements, thus providing a film unit or film packet whose external surfaces are dry. The processing composition is viscous and preferably is distributed from a single-use rupturable container; such pressure rupturable processing containers are frequently referred to as "pods". The final image may be black-and-white, monochrome or multicolor and either negative or positive with respect to the photographed subject. The present invention is especially, if not uniquely, adapted for facilitating processing outside of a camera film units which are maintained as an integral laminate after processing, the desired image being viewed through one face of said laminate.

In diffusion transfer processes within this invention the diffusible image-providing substance may be a complete dye or a dye intermediate, e.g., a color couper. The preferred embodiments of this invention use a dye developer, that is, a compound which is both a silver halide developing agent and a dye disclosed in U.S. Pat. No. 2,983,606, issued May 9, 1961 to Howard G. Rogers. As is now well known, the dye developer is immobilized or precipitated in developed areas as a consequence of the development of the latent image. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer to provide a reversed or positive color image of the developed image. The image-receiving layer preferably contains a mordant for transferred unoxidized dye developer. As disclosed in the aforementioned U.S. Pat. Nos. 2,983,606 and 3,415,644, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

Multicolor images may be obtained using the color image-forming components, for example, dye developers, in an integral multi-layer photosensitive element, such as is disclosed in the aforementioned U.S. patents and in U.S. Pat. No. 3,345,163 issued Oct. 3, 1967 to Edwin H. Land and Howard G. Rogers. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning as a yellow filter, a separate yellow filter may be omitted.

For convenience, further description of this invention will be in the context of the use of dye developers and positive transfer images. Reference is now made to the accompanying drawing wherein an embodiment of this invention is illustrated and wherein like numbers refer to like components.

Referring to the FIGURE, Stages A, B and C show diagrammatic cross-section, respectively, imaging, processing, and the finished print in one embodiment of this invention. For ease of understanding, the FIGURE illustrates the formation of a monochrome image using a single dye developer. In Stage A, there is shown a photosensitive element 30 in superposed relationship with an image-receiving element 32, with a rupturable container 16 (holding an opaque processing composition 17) so positioned as to discharge its contents between said elements upon suitable application of pressure, as by passing through a pair of pressure applying rolls or other pressure applying means (not shown). Photosensitive element 30 comprises an opaque support 10 carrying a layer 12 of a dye developer over which has been coated a silver halide emulsion layer 14. The image-receiving element 32 comprises a transparent support 24 carrying, in turn, a polymeric acid layer 22, a spacer layer 20, an image-receiving layer 18 and a decolorized layer 26. Photoexposure of the silver halide emulsion layer is effected through the transparent support 24 and the layers carried thereon, i.e., the polymeric acid layer 22, the spacer layer 20, the image-receiving layer 18 and the decolorizing layer 26, which layers are also transparent, the film unit being so positioned within the camera that light admitted through the camera exposure or lens system is incident upon the outer or exposure surface **24*a* of the transparent support 24. After exposure the film unit is advanced between suitable pressure-applying members, rupturing the container 16, thereby releasing and distributing a layer 17*a* of the opaque processing composition and thereby forming a laminate, as illustrated in processing Stage B, of the photosensitive element 30 and the image-receiving element 32 with their respective support members providing the outer layers of the laminate (illustrated in Stage B). The opaque processing composition contains a film-forming polymer, a white pigment and has an initial pH at which one or more optical filter agents contained therein are colored; the optical filter agent (agents) is (are) selected to exhibit the appropriate light absorption, i.e., optical density, over the wavelength range of light actinic to the particulr silver halide emulsion(s). As a result, ambient or environmental light within that wavelength range incident upon transparent support surface 24*a* and transmitted transversely through said transparent support and the transparent layers carried thereon in the direction of the exposed silver halide emulsion 14*a* is absorbed thereby avoiding further exposure of the photoexposed and developing silver halide emulsion 14*a*. In exposed and developed areas, the dye developer is oxidized as a function of the silver halide development and immobilized. Unoxidized dye developer associated with undeveloped and partially developed areas remains mobile and is transferred imagewise to the image-receiving layer 18 to provide the desired positive image therein. Permeation of the alkaline processing composition through the image-receiving layer 18 and the spacer layer 20 to the polymeric acid layer 22 is so controlled that the process pH is maintained at a high enough level to effect the requisite development and image transfer and to retain the optical filter agent (agents) in colored form within the processing composition layer 17*a* and on the silver halide emulsion side of said layer 17***a*, after which pH reduction effected as a result of alkali permeation into the polymeric acid layer 22 is effective to reduce the pH to a level which changes the optical filter agent to a colorless form. Absorption of the water from the applied layer 17*a* of the processing composition results in a solidified film composed of the film-forming polymer and the white pigment dispersed therein, thus providing reflecting layer 17*b* which also serves to laminate together the photosensitive component 30 and the image-receiving component 32 to provide the final laminate (Stage C). The positive transfer image in dye developer present in the image-receiving layer 18*a* is viewed through the transparent support 24 and the intermediate transparent layers against the reflecting layer 17*b* which provides an essentially white background for the dye image and also effectively masks from view the developed silver halide emulsion 14*b* and dye developer immobilized therein or remaining in the dye developer layer 12.

The optical filter agent is retained within the final film unit laminate and is preferably colorless in its final form, i.e., exhibiting no visible absorption to degrade the transfer image or the white background therefor provided by the reflecting layer 17*b*. The optical filter agent may be retained in the reflecting layer under these conditions, and it may contain a suitable "anchor" or "ballast" group to control its diffusion into adjacent layers. Some of the optical filter agent may diffuse into the photosensitive component and be mordanted by the gelatin or other material present on the silver halide emulsion side of the reflecting layer 17*b;* optical filter mordanted in the photosensitive component 30 may be colorless or colored in its final state so long as any color exhibited by it is effectively masked by the reflecting layer 17*b*. In a preferred embodiment, the image-receiving element is free of gelatin; the photosensitive element contains gelatin, and the optical filter agent(s) is a pH-sensitive phthalein dye.

In the illustrated embodiment, photoexposure is effected through the image-receiving element. While this is a particularly useful and preferred embodiment, especially where the photosensitive element and the image-receiving element are secured together as shown in U.S. Pat. Nos. 3,415,644 and 3,647,437, it will be understood that the image-receiving element may be initially positioned out of the exposure path and superposed upon the photosensitive element after photoexposure.

A light-absorbing optical filter agent, preferably a pH-sensitive dye such as an indicator dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the optical filter agent is so positioned and/or constituted after processing as not to interfere with viewing the desired image shortly after said image has been formed. In the preferred embodiments, the optical filter agent is initially contained in the processing composition in colored form together with a light-reflecting material, e.g., titanium dioxide.

The concentration of indicator dye is selected to provide the optical transmission density required, in combination with other layers intermediate the silver halide emulsion layer(s) and the incident radiation, to prevent nonimagewise exposure, i.e., fogging, by incident actinic light during the performance of the particular photographic process. The transmission density and the indicator dye concentration necessary to provide the requisite protection from incident light may be readily determined for any photographic process by routine experimentation, as a function of film speed or sensitivity, processing time, anticipated incident light intensity, etc., as described in said U.S. Pat. No. 3,647,437. It will be recognized that a particular transmission density may not be required for all portions of the spectrum, lesser density being sufficient in wavelength regions corresponding to lesser sensitivities of the particular photosensitive material.

In a particularly useful embodiment, the light-absorbing dye is highly colored at the pH of the processing composition, e.g., 13–14, but is substantially non-absorbing of visible light at a lower pH, e.g., less than 10–12. Particularly suitable are phthalein dyes having a pKa of about 13 to 13.5; many such dyes are described in the aforementioned U.S. Pat. No. 3,647,437. This pH reduction may be effected by an acid-reacting reagent appropriately positioned in the film unit, e.g., in a layer between the transparent support and the image-receiving layer, as described in more detail below.

It will be understood that a mixture of light-absorbing materials may be used so as to obtain absorption in all critical areas of the visible and near-visible by which the silver halide emulsions, e.g., a panchromatic black-and-white silver halide emulsion or a multicolor silver halide photosensitive element, being used are exposable. Many dyes which change from colored to colorless as a function of pH reduction, e.g., phthalein dyes, are known and appropriate selection may be made by one skilled in the art to meet the particular conditions of a given process and film unit; such dyes are frequently referred to in the chemical and related arts as indicator dyes.

The decolorizing agent contained in the decolorizing layer may effect decolorization by any method suitable for the particular optical filter agent(s). One such method is the use of a very thin layer 26 of a polymeric acid, such as polyacrylic acid. If such a nondiffusible acid is used, its concentration should be kept quite low so that it does not reduce the pH within the processing composition layer 17*a* and cause premature decolorization or discharge of the optical filter agent therein, or significantly reduce the density of the transfer image.

In the preferred embodiments of this invention, the decolorizing agent is a neutral polymeric material, such as a polyvinyl pyrrolidone or a polyether polymer, and may be used by itself or in admixture with another polymer.

The decolorizing agent should be substantially non-diffusing from the decolorizing layer into the processing composition, thereby avoiding premature discharge of the optical filter agent present in the processing composition layer. Accordingly, the molecular weight should be appropriately selected as discussed later.

The ability of a given agent to decolorize the particular optical filter agent(s) may be readily determined by a procedure such as the following: the optical filter agent in question is dissolved in 1.5 molar aqueous potassium hydroxide to provide a solution of about 0.01 weight percent of the optical filter agent in a test tube. The test decolorizing agent is added to the test tube in small increments. Decolorizing agents which decolorize or substantially reduce the visible absorption of the optical filter agent when added to the potassium hydroxide in quantities less than about 35 times (by weight) the optical filter agent concentration in said solution are preferred as they avoid the need to use undesirably high decolorizing layer coverages, e.g., such thickness as might undesirably slow down or reduce the transfer of image dye.

The following table shows the results obtained when the above-described test tube test is performed using the polyoxyethylene polyoxypropylene block copolymer commercially available under the tradename "Pluronic F-127" from BASF Wyandotte Corp. (average molecular weight about 12,500). Similar results have been obtained using the polyoxyethylene polymer

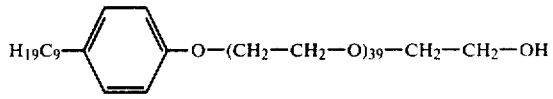

commercially available under the tradename "Igepal CO-890" from the GAF Corporation.

| Optical Filter Agent | Weight Ratio | Results |
|---|---|---|
| No. 1: 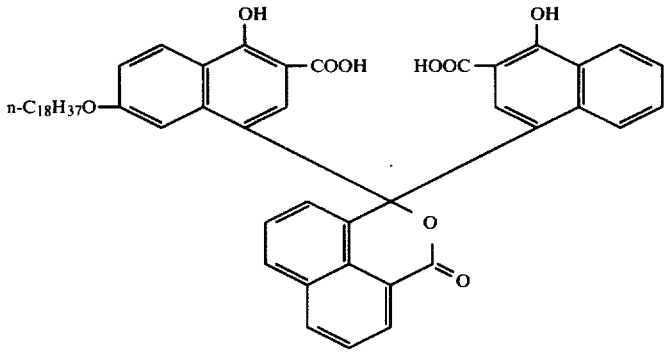 | 3:1 | Decolorizes |
| No. 2: 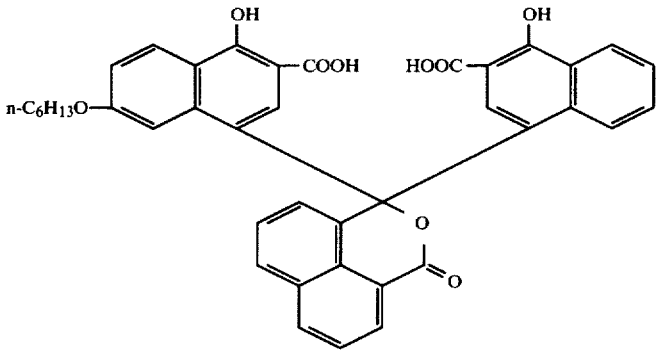 | 3:1 | Decolorizes |
| No. 3: 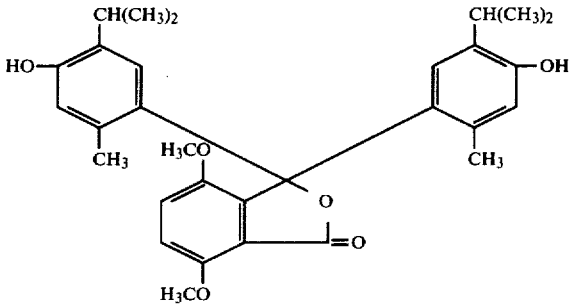 | >100:1 | Does Not Decolorize |
| No. 4: 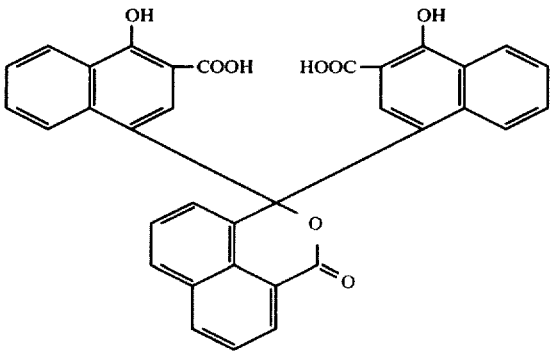 | >100:1 | Decolorizes |

-continued

| Optical Filter Agent | Weight Ratio | Results |
|---|---|---|
| No. 5: 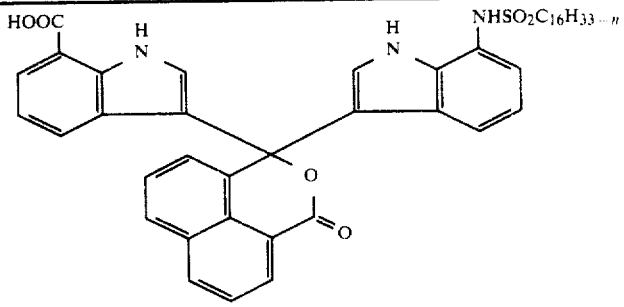 | 30:1 | Solution color changes from deep orange to pale tan; addition of acid completes decolorization |
| No. 6: 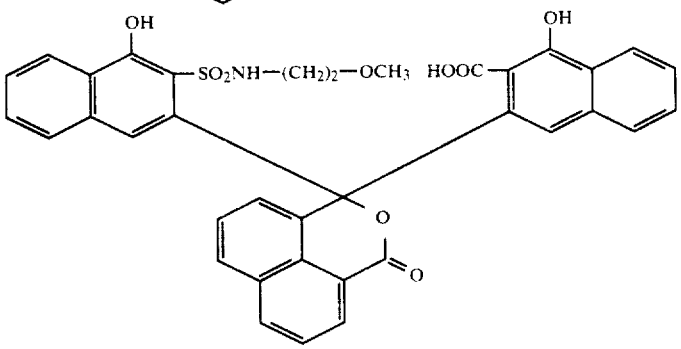 | 16:1 | Decolorizes |
| No. 7: 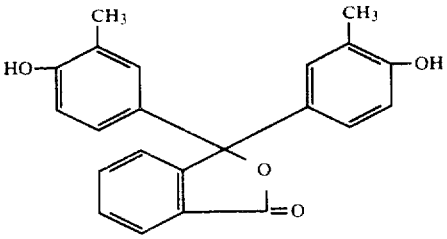 | >100:1 | Does Not Decolorize |
| No. 8: 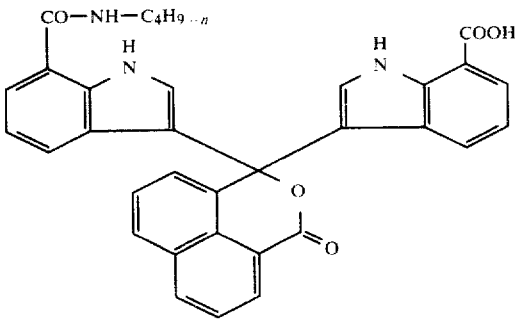 | >100:1 | Does Not Decolorize |

The mechanism by which the decolorization occurs in the above described test is not completely understood. It has been determined that the addition of the Pluronic F-127 or Igepal CO-890 did not change the pH. It appears that the presence of a long chain substituent on the phthalein dye markedly reduces the quantity of polyether required to effect decolorization. It also appears that phthalein dyes containing the grouping

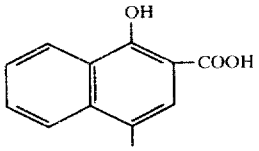

are more readily decolorized by the polyether.

Experiments have shown that in at least some instances decolorization of a pH-sensitive optical filter agent in alkaline solution is the result of the formation of a complex of the decolorizing agent with the pH-sensitive dye, such complex exhibiting a higher apparent pKa than said pH-sensitive dye in said alkaline solution. This complexation is believed to involve the cation of the alkali, e.g., $K^+$. Where the cation binding increases the bulk or polarizability the apparent pK moves higher, thus "decolorizing" without reducing the pH. The polyethers found useful have the property of binding cations, and when many cations are bound the polyether or other polymer decolorizing agent becomes a "super cation" and changes the apparent pK of the phthalein dye.

As noted above, use of a polyoxyethylene polyoxypropylene block copolymer has been found to be particularly useful in the practice of this invention. Such block copolymers may be represented by the formula $$HO-(CH_2CH_2-O-)_a(\underset{\underset{CH_3}{|}}{CH}-CH_2-O-)_b(CH_2CH_2O-)_cH$$

Varying the ratios a, b and c will vary the hydrophobic-hydrophillic balance of the block copolymer and such varying may be of value in the practice of this invention. Other polyoxyalkylene polymers, such as high molecular weight polyethylene glycol (m.wt. 6000) commercially available under the tradename Carbowax 6000 also may be used, although the above block copolymers are more effective and are preferred.

Another material which has been found to be effective in decolorizing at least some of the above phthalein indicator dyes is poly-N-vinylpyrrolidone, e.g., that available under the tradename Type NP K-90 from GAF Corp.

Where the optical filter agent is a pH-sensitive dye, such as a phthalein dye, it is also within the scope of this invention to decolorize the optical filter agent immediately adjacent the interface of the positive component and the processing composition layer by effecting a pH reduction limited in area to this location. Such a controlled decolorization by pH reduction may be effected by using a very thin coating of a polymeric acid as the decolorizing layer. As an example of such a polymeric acid decolorizing layer, mention may be made of a layer of about 15-25 mg/ft$^2$ of a polyacrylic acid which has been adjusted to a pH of about 4 with potassium hydroxide. Use of such a thin polymeric acid layer, and particularly one which has been partially neutralized, avoids discharging the remainder of the optical filter agent or premature reduction of the pH with consequent reduction of dye transfer density.

The following examples are given to illustrate the invention and are not intended to be limiting. All parts and percentages are by weight unless otherwise stated.

EXAMPLE 1

A multicolor photosensitive element using, as the cyan, magenta and yellow dye developers cyan:

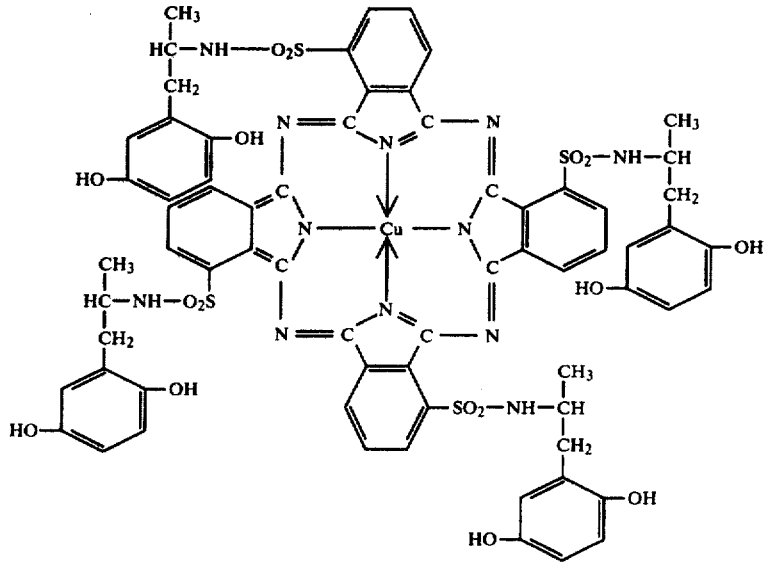

magenta:

-continued

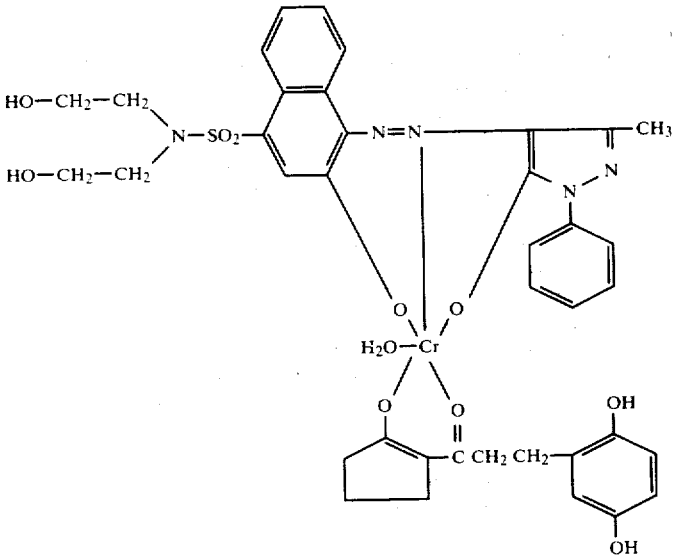

yellow:

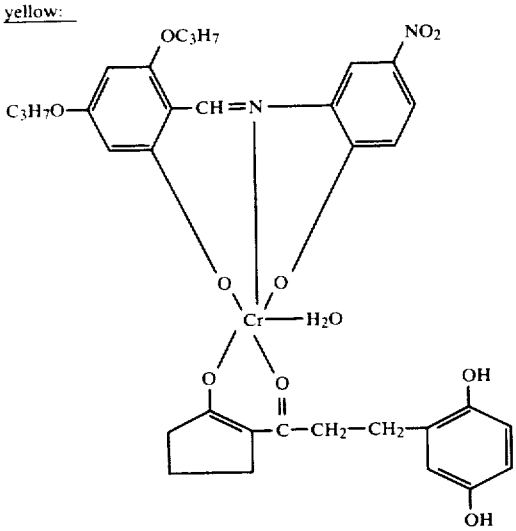

was prepared by coating a gelatin-subcoated 4 mil opaque polyethylene terephthalate film base with the following layers:

1. a layer of cyan dye developer dispersed in gelatin and coated at a coverage of about 69 mg/ft$^2$ of dye and about 25 mg/ft$^2$ of gelatin, and also containing about 25 mg/ft$^2$ of 2-phenyl benzimidazole, and about 6.3 mg/ft$^2$ of 4'-methylphenyl hydroquinone;

2. a red-sensitive gelatino silver iodobromide emulsion coated at a coverage of about 120 mg/ft$^2$ of silver and about 72 mg/ft$^2$ of gelatin;

3. a layer of a 60-30-4-6 copolymer of butylacrylate, diacetone acrylamide, styrene and methacrylic acid and polyacrylamide coated at a coverage of about 232.8 mg/ft$^2$ of the copolymer and about 7.2 mg/ft$^2$ of polyacrylamide;

4. a layer of magenta dye developer dispersed in gelatin and coated at a coverage of about 60 mg/ft$^2$ of dye and about 42 mg/ft$^2$ of gelatin, and also containing about 21 mg/ft$^2$ of 2-phenyl benzimidazole;

5. a green-sensitive gelatino silver iodobromide emulsion coated at a coverage of about 74 mg/ft$^2$ of silver and about 36 mg/ft$^2$ of gelatin;

6. a layer containing the copolymer referred to above in layer 3 and polyacrylamide coated at a coverage of about 127 mg/ft$^2$ of copolymer and about 8.1 mg/ft$^2$ of polyacrylamide, and about 6.6 mg/ft$^2$ of succinaldehyde;

7. a layer of yellow dye developer dispersed in gelatin and coated at a coverage of about 90 mg/ft$^2$ of dye and about 42 mg/ft$^2$ of gelatin, and also containing about 19 mg/ft$^2$ of 2-phenyl benzimidazole;

8. a blue-sensitive gelatino silver iodobromide emulsion layer including 4'-methylphenyl hydroquinone coated at a coverage of about 119 mg/ft$^2$ of silver, about 62 mg/ft$^2$ of gelatin and about 19 mg/ft$^2$ of 4'-methylphenyl hydroquinone; and 9. a layer of gelatin coated at a coverage of about 45 mg/ft$^2$ of gelatin and containing about 4 mg/ft$^2$ of carbon black.

A transparent 4 mil polyethylene terephthalate film base was coated, in succession, with the following layers to form an image-receiving component:

1. as a polymeric acid layer, a mixture of a partial butyl ester of polyethylene/maleic anhydride copolymer and polyvinyl butyral at a ratio of about 9:1 at a coverage of about 2,500 mg/ft$^2$;

2. a timing layer containing about a 45:0.7 ratio of a 60-30-4-6 copolymer of butylacrylate, diacetone acrylamide, styrene and methacrylic acid and polyvinyl alcohol at a coverage of about 450 mg/ft$^2$; and 3. an image-receiving layer containing a 2:1:1 mixture of polyvinyl alcohol, poly-4-vinyl pyridine and a graft copolymer of 4'-vinyl pyridine and vinylbenzyl trimethyl ammonium chloride on hydroxyethyl cellulose (2.2:1:2.2 ratio) at a coverage of about 300 mg/ft$^2$. Over the image-receiving layer there was coated about 100 mg/ft$^2$ of a 70:30 mixture of Pluronic F-127 polyoxyethylene polyoxypropylene block copolymer and polyvinyl alcohol as a decolorizing layer. The photosensitive component was photoexposed and then taped to one end of the image-receiving component with a rupturable container retaining an aqueous alkaline processing solution fixedly mounted on the leading edge of each of the components, by pressure-sensitive tapes to make a film unit, so that, upon application of compressive pressure to the container to rupture the container's marginal seal, its contents would be distributed between the decolorizing layer and the gelatin overcoat layer of the photosensitive component. The photoexposure was such that a portion was given a "white" exposure, i.e., all three silver halide layers were fully exposed so that the corresponding area of the positive transfer image would be "white". The aqueous alkaline processing composition comprised:

| | | |
|---|---|---|
| Water | 100 | cc. |
| Potassium hydroxide (85%) | 10.1 | g. |
| N-phenethyl-α-picolinium bromide | 2.6 | g. |
| Titanium dioxide | 77.1 | g. |
| 6-methyl uracil | 0.6 | g. |
| bis-(β-aminoethyl)-sulfide | 0.04 | g. |
| Benzotriazole | 1.1 | g. |
| Colloidal silica (solids based on 30% $SiO_2$ dispersion) | 0.56 | g. |
| N-2-hydroxyethyl-N,N',N'-tris-carboxymethyl-ethylene diamine | 1.52 | g. |
| 4-aminopyrazolo (3,4d)pyrimidine | 0.51 | g. |
| polyethylene glycol (molecular weight about 4000) | 0.91 | g. |
| poly-diacetone acrylamide oxime | 1.6 | g. |
| 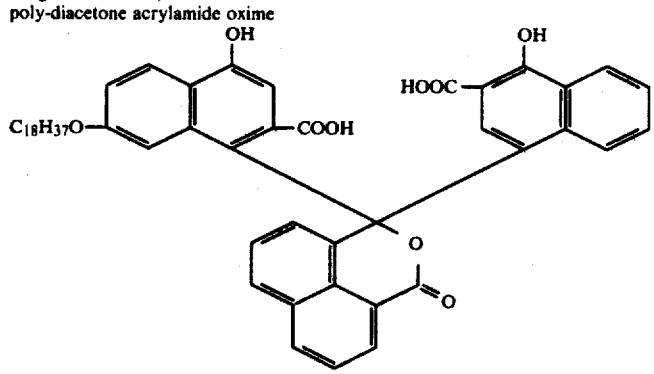 | 2.74 | g. |
| 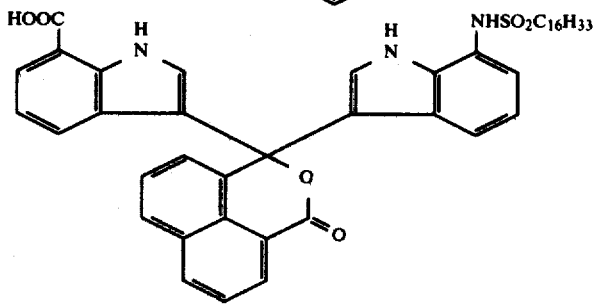 | 0.6 | g. |

A layer approximately 0.0030" thick of the processing composition was distributed by passing the film unit between a pair of pressure-applying rolls and into a lighted area. The resulting laminate was maintained intact to provide a multicolor integral negative-positive reflection print which exhibited good color quality and separation.

A control differing only in the absence of the decolorizing layer was processed in the same manner. The red, green and blue reflection densities of the "white" area of the transfer image were measured at intervals indicated before, beginning 10 seconds after the processing composition was applied.

| | Test | | | Control | | |
|---|---|---|---|---|---|---|
| | Red | Green | Blue | Red | Green | Blue |
| 10 sec. | 0.31 | 0.26 | 0.26 | 0.51 | 0.39 | 0.40 |
| 20 sec. | 0.29 | 0.25 | 0.24 | 0.49 | 0.40 | 0.40 |
| 30 sec. | 0.29 | 0.25 | 0.24 | 0.47 | 0.41 | 0.40 |
| 40 sec. | 0.29 | 0.26 | 0.23 | 0.44 | 0.43 | 0.40 |
| 60 sec. | | | | 0.40 | 0.39 | 0.38 |
| 120 sec. | | | | 0.31 | 0.33 | 0.29 |

As will be apparent from the above comparison, the use of the decolorizing layer in 10 seconds reduced the reflection densities attributable to the optical filter agent to densities which required 120 seconds to obtain in the absence of this layer.

EXAMPLE 2

The procedure described in Example 1 was repeated with a photosensitive element using the same yellow and cyan dye developers and a magenta dye developer of the formula

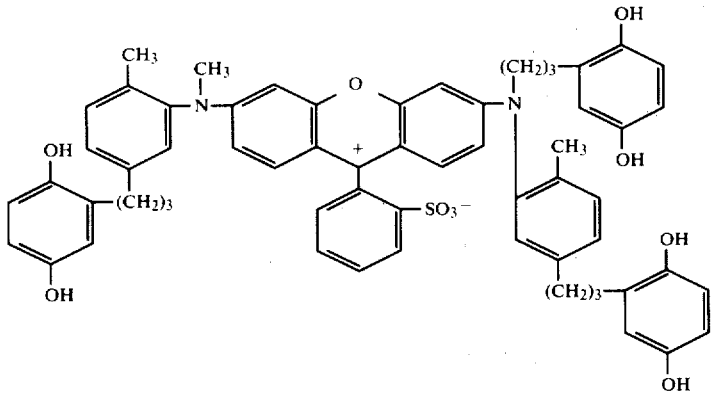

and prepared by coating a gelatin-subcoated 4 mil opaque polyethylene terephthalate film base with the following layers:

1. a layer of cyan dye developer dispersed in gelatin and coated at a coverage of about 630 mg/m$^2$ of dye, about 391 mg/m$^2$ of gelatin, about 280 mg/m$^2$ of N-n-dodecylamino-purine, and about 88 mg/m$^2$ of 4'-methylphenyl hydroquinone;
2. a red-sensitive gelatino silver iodobromide emulsion coated at a coverage of about 1054 mg/m$^2$ of silver and about 6324 mg/m$^2$ of gelatin;
3. a layer of a 95:5 mixture of a 60-30-4-6 copolymer of butylacrylate, diacetone acrylamide, styrene and methacrylic acid and polyacrylamide coated at a coverage of about 1076 mg/m$^2$;
4. a layer of magenta dye developer dispersed in gelatin and coated at a coverage of about 648 mg/m$^2$ of dye and about 324 mg/m$^2$ of gelatin;
5. a green-sensitive gelatino silver iodobromide emulsion coated at a coverage of about 749 mg/m$^2$ of silver and about 330 mg/m$^2$ of gelatin;
6. a layer containing the copolymer referred to above in layer 3 and polyacrylamide in a 91:9 ratio coated at a coverage of about 1816 mg/m$^2$;
7. a layer of yellow dye developer dispersed in gelatin and coated at a coverage of about 659 mg/m$^2$ of dye, about 318 mg/m$^2$ of gelatin, and about 108 mg/m$^2$ of N-n-dodecylamino-purine;
8. a blue-sensitive gelatino silver iodobromide emulsion layer coated at a coverage of about 990 mg/m$^2$ of silver, about 495 mg/m$^2$ of gelatin; and
9. a layer of gelatin coated at a coverage of about 320 mg/m$^2$ of gelatin. Using the image-receiving component containing the decolorizing layer and the same procedure and processing composition as in Example 1, the following reflection densities of the "white" area were measured at the noted number of seconds after the processing composition was applied:

| | Red | Green | Blue |
|---|---|---|---|
| 10 sec. | 37 | 31 | 32 |
| 20 sec. | 34 | 30 | 30 |
| 30 sec. | 34 | 30 | 30 |
| 40 sec. | 34 | 30 | 30 |

An image-receiving element found to be effective in practicing this invention was prepared as described in Example 1 except that the timing layer comprised a mixture of about 7 parts of hydroxypropyl cellulose (Klucel J12HB sold by Hercules, Inc.) and about 4 parts of polyvinyl alcohol, coated to form a layer about 0.27 mils thick.

EXAMPLE 4

An image-receiving element found to be effective in practicing this invention was prepared by coating a transparent 4 mil polyethylene terephthalate film base with the following layers:

1. as a polymeric acid layer, a mixture of a partial butyl ester of polyethylene/maleic anhydride copolymer and polyvinyl butyral at a ratio of about 9:1 at a coverage of about 2450 mg/ft$^2$;
2. a timing layer containing about a 45:0.7 ratio of a 60-30-4-6 copolymer of butylacrylate, diacetone acrylamide, styrene and methacrylic acid and polyvinyl alcohol at a coverage of about 300 mg/ft$^2$;
3. an image-receiving layer comprising 300 mg/ft$^2$ of a graft copolymer of 4-vinylpyridine and vinylbenzyl trimethyl ammonium chloride on hydroxyethyl cellulose in a 2.2:1:2.2 ratio and a small quantity of a hardening agent; and
4. a decolorizing layer comprising 70 mg/ft$^2$ of Pluronic F-127 polyoxyethylene polypropylene block copolymer and 30 mg/ft$^2$ of polyvinyl alcohol.

In certain embodiments of this invention it has been found that the inclusion of a small quantity, e.g., about 1-1.5%, of N-methyl imidazole in the processing composition may improve the color balance of the transfer image.

It will be recognized that polyoxyalkylene polymers contemplated for use as decolorizing agents in accordance with this invention tend to be waxy materials which if used alone form relatively soft coatings. For this reason it is frequently desirable to mix the polyoxyalkylene polymer with another polymer to provide a layer which is less subject to removal during film manufacture or photographic processing. A particularly useful polymer for this purpose is polyvinyl alcohol. Such a mixed polymer decolorizing layer may be particularly useful in embodiments where the positive and negative components are temporarily laminated, as discussed above, prior to distribution of the processing composition, so that the components may be delaminated by the processing composition without harm to the decolorizing layer.

The concentration of the decolorizing agent effective for any particular photographic system may be readily determined by routine experimentation. In the above examples, the decolorizing layer comprised a 70:30 mixture by weight of Pluronic F-127 polyoxyethylene polyoxypropylene block copolymer and polyvinyl alcohol coated at about 100 mg/ft$^2$. As an indication of the wide concentrations which may be used, it may be noted that good results also have been obtained with the same polymer mixture coated at about 25 mg/ft$^2$.

In a particularly useful embodiment the decolorizing layer comprises a polyoxyalkylene polymer hydrogen-bonded to another polymer to provide a "hard" decolorizing layer so as to resist rub off and blocking. A particularly effective polymer for hydrogen bonding a polyether decolorizing agent is a copolymer of diacetone acrylamide and methacrylic acid, preferably a 1:1 monomer ratio. Hydrogen bonding—a non-valent bonding—is believed to occur between the —COOH groups provided by the methacrylic acid and the oxygen of the ether group ($—CH_2—CH_2—O—CH_2—CH_2$). The diacetone acrylamide provides a hydrophobic property, and the ratio of the two monomers may be adjusted to provide the balance of hydrophilic and hydrophobic properties desired for a given photographic system. 1:1 copolymers of methacrylic acid and diacetone acrylamide having a molecular weight of about 10,000 to 20,000 have been found to be particularly useful. The polymeric polyether preferably has a molecular weight of at least about 2,000; the molecular weight in combination with the hydrophillic/hydrophobic properties of the polymeric polyether should be such as to render it substantially nondiffusible from the decolorizing layer. Where the ether groups do not hydrogen bond with sufficient —COOH groups to give the desired "hardness", e.g., because the molecular geometry does not provide the appropriate "fit", another hydrogen bonding polymer, e.g., polyvinyl pyrrolidone, may be incorporated. Hydrogen bonding also may occur between the carboxyl group and the amide groups. The particular hydrogen bonding group is not important, and suitable materials may be readily selected by routine experimentation. The hydrogen bonded complex should precipitate in water. The hydrogen bond is reversible in aqueous alkaline solution, thus making the polyether decolorizing agent available to complex with the phthalein optical filter agent and to permit rapid diffusion of the image dye(s) through the decolorizing layer to the image-receiving layer.

As noted above, methacrylic acid is a preferred monomer in the hydrogen bonding polymer. Acrylic acid also may be used but is a less effective hydrogen bonding agent, possibly because fewer carboxyl groups are properly positioned to hydrogen bond with the polyether. The pendant methyl groups of the methacrylic acid moieties are believed to limit the ability of the carboxyl group to rotate around the polymer backbone, so that more of the carboxyl groups are properly positioned.

In the preferred embodiment of this invention the decolorizing layer comprises a mixture of a 1:1 diacetone acrylamide/methacrylic acid copolymer, the nonyl phenol mono ether of a polyethylene glycol (n=40) (Igepal CO-890), and a low molecular weight polyvinyl pyrrolidone, e.g., "PVP K-30" polyvinyl pyrrolidone having a molecular weight of about 15,000 and commercially available from GAF Corporation. Suitable ratios of these components, respectively, include 1.0/1.0/0.35 and 1.0/0.75/0.35 parts by weight. Such mixtures may be coated at a coverage of about 50 to 100 mg./ft$^2$ (about 538 to 1076 mg/m$^2$. Suitable coating solvents include aqueous ethanol, to which may be added a ketone such as methyl ethyl ketone. The solvent system should be selected to avoid having an adverse effect upon the image-receiving layer and to minimize the formation of haze. Examples of suitable solvent systems for coating such decolorizing layers include (by volume) (1) an 80/20 water/ethanol mixture and (2) 50/35/15 acetone, ethanol and water. The DAA/MAA copolymer is added as the ammonium salt, with the free acid being regenerated during drying by volatilization of ammonia.

The following examples illustrate image-receiving elements employing hydrogen bonded decolorizing layers. All parts and percentages are by weight unless otherwise stated.

EXAMPLE 5

An image-receiving element was prepared by coating a transparent subcoated polyethylene terephthalate 4 mil (0.1 mm) support with the following layers:

1. a neutralizing layer comprising approximately 9 parts of a half-butyl ester of polyethylene/maleic anhydride and 1 part of polyvinyl butyral coated at a coverage of about 2500 mg./ft$^2$ (about 26,900 mg/m$^2$);

2. a timing layer comprising about 270 mg./ft$^2$ (about 2900 mg/m$^2$) of a 60.6/29/6.3/3.7/0.4 pentapolymer of butylacrylate, diacetone acrylamide, styrene, methacrylic acid and acrylic acid and about 30 mg./ft$^2$ (about 320 mg./ft$^2$ of polyvinyl alcohol;

3. an image-receiving layer coated at a coverage of about 300 mg./ft$^2$ (about 3330 mg/m$^2$) of a mixture of 3 parts of (a) a 2:1 mixture of polyvinyl alcohol and poly-4-vinyl pyridine and 1 part of (b) a graft copolymer comprising 4-vinyl pyridine (4VP) and vinyl benzyl trimethyl ammonium chloride (TMQ) grafted onto hydroxyethyl cellulose (HEC) at a ratio HEC/4VP/TMQ of 2.2/2.2/1, and about 10 mg./ft$^2$ (about 108 mg/m$^2$) of 1,4-butanediol diglycidyl ether cross-linking agent; and 4. a decolorizing layer coated at a coverage of about 100 mg./ft$^2$ (about 1076 mg/m$^2$) and comprising 1 part of a tetrapolymer of diacetone acrylamide, methacrylic acid, styrene and butyl acrylate at a ratio of 1/1/0.1/0.1, 0.75 part of Igepal CO-890 nonylphenoxyethylene oxide ethanol and 0.35 part of polyvinyl pyrrolidone.

EXAMPLE 6

An image-receiving element was prepared as described in Example 5 except that the copolymer of diacetone acrylamide and methacrylic acid was 1:1.

EXAMPLE 7

An image-receiving element was prepared as described in Example 6 except that the ratio of the diacetone acrylamide/methacrylic acid polymer, Igepal CO-890 and polyvinyl pyrrolidone was 1/0.75/0.35.

EXAMPLE 8

An image-receiving element was prepared as described in Example 7 except that the neutralizing and timing layers were omitted.

EXAMPLE 9

An image-receiving element was prepared by coating a transparent subcoated polyethylene terephthalate 4 mil (0.1 mm) support with the following layers:

1. an image-receiving layer comprising about 3170 mg./m$^2$ of a graft copolymer of 2.2 parts 4-vinyl pyridine and 1 part vinyl benzyl trimethyl ammonium chloride on 2.2 parts of hydroxyethyl cellulose and about 43 mg./m$^2$ of 1,4-butanediol diglycidyl ether; and 2. a decolorizing layer comprising about 1076 mg/m$^2$ of a mixture of 1 part 1:1 copolymer of diacetone acrylamide and methacrylic acid, 0.75 part Igepal CO-890, and 0.35 part of polyvinyl pyrrolidone.

When the above described image-receiving elements of Examples 5 to 9 were used in an integral multicolor diffusion transfer process of the Polaroid SX-70 type using multilayer negative of the type described in Example 2 using a layer approximately 0.0026 inch thick of a processing composition containing:

| | |
|---|---|
| Water | 40.80 g. |
| Potassium hydroxide (100%) | 4.59 g. |
| Poly-diacetone acrylamide oxime | 0.67 g. |
| Titanium dioxide | 48.49 g. |
| Benzotriazole | 0.46 g. |
| 4-aminopyrazolo-(3,4d)-pyrimidine | 0.24 g. |
| 6-methyl uracil | 0.25 g. |
| N-2-hydroxyethyl-N,N',N'-tris-carboxymethyl-ethylene diamine | 0.63 g. |
| Polyethylene glycol (mol. wt. about 4000) | 0.38 g. |
| bis-(β-aminoethyl)-sulfide | 0.017 g. |
| Colloidal silica (30% dispersion) | 0.78 g. |
| N-phenethyl-α-picolinium bromide | 1.07 g. |
| 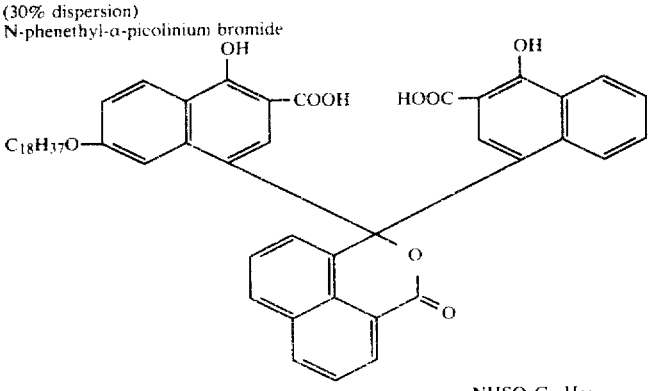 | 1.31 g. |
| 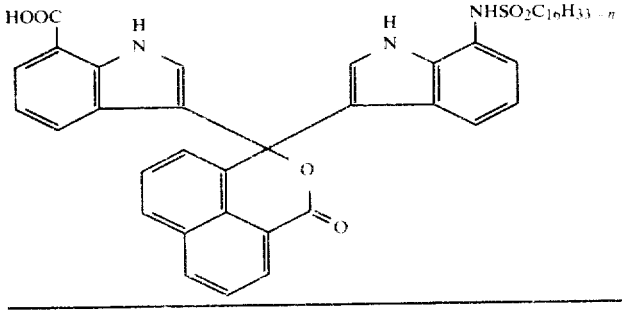 | 0.29 g. |

good multicolor transfer images were obtained. The background provided by the layer of titanium dioxide appeared apparently substantially white to the viewer within about 5 to 10 seconds after the processing composition was distributed between the image-receiving element, demonstrating that the decolorizing polyether had been effective. The decolorizing layers were found to be very resistant to rub off and blocking.

Where the image-receiving element does not contain a neutralizing layer and a timing layer, as in Examples 8 and 9 above, these layers were coated in the photosensitive element between the opaque support and the cyan dye developer layer, as described in U.S. Pat. No. 3,573,043 issued Mar. 30, 1971 to Edwin H. Land.

The use of a hydrogen bonding polymer to increase the hardness of the decolorizing layer is the subject of the copending application of Irena Y. Bronstein-Bonte, Edward P. Lindholm and Lloyd D. Taylor, Ser. No. (143,281) filed Apr. 24, 1980.

In certain embodiments of this invention, the positive component 32 and the negative component 30 are temporarily laminated to each other so that the decolorizing layer 26 is in optical contact with the outer layer of the negative component 30. This bond should be of such a nature that these layers may be readily separated by the distribution of the processing composition following rupture of the pod 17. A particularly useful method of providing such a temporary lamination is to apply an aqueous solution of a polyethylene glycol, e.g., a polyethylene glycol having a molecular weight of about 6000 such as that commercially available under the tradename "Carbowax 6000" from Union Carbide Corporation. Such uses of polyethylene glycols are disclosed in U.S. Pat. No. 3,793,023 issued Feb. 19, 1974 to Edwin H. Land and to which reference may be made. A particularly useful composition to provide such a temporary lamination is a 50:50 mixture by weight of Carbowax 6000 and Pluronic F-127.

In certain preferred embodiments of this invention, the positive component 32 and the negative component 30 are held in superposed relationship without being temporarily laminated together. In such embodiments the decolorizing layer also acts to prevent blocking of the positive and negative components in the integral film unit during storage prior to use.

It is well known in the art that for in camera processing the processing composition should include a viscosity-increasing polymer of the type which, when the composition is spread and dried, forms a relatively firm and stable film. High molecular weight polymers are preferred, and include cellulosic polymers such as sodium carboxymethyl cellulose, hydroxyethyl cellulose and hydroxyethyl carboxymethyl cellulose. Another class of useful viscosity-increasing polymers comprises the oxime polymers disclosed and claimed in the copending application of Lloyd D. Taylor, Ser. No. 894,545 filed Apr. 7, 1978 now U.S. Pat. No. 4,202,694 issued May 13, 1980. Suitable oxime polymers include polydiacetone acrylamide oxime as well as copolymers, e.g., grafts of diacetone acrylamide oxime onto hydroxyethyl cellulose. It has been found that the decolorizing of the optical filter agent immediately adjacent the interface is particularly effective when the concentration of the viscosity-providing polymer is about 1% by weight or less, e.g., about 0.8% by weight as in the above examples.

Neutralizing layers such as the polymeric acid layer 22 are well known in the art and are described in detail, for example, in the above-noted U.S. Pat. Nos. 3,415,644, 3,573,043 and 3,647,437.

In the preferred embodiments of this invention the polyether decolorizing agent is in a layer between the image-receiving layer and the layer of processing composition containing the optical filter agent. Addition of the polyoxyalkylene decolorizing agents to the image-receiving layer also has been found to be useful. A higher concentration per unit area of the polyether decolorizing agent is necessary, however, when it is incorporated in the image-receiving layer in order to have the requisite concentration adjacent the interface. Image-receiving elements wherein the polyether decolorizing agent has been incorporated into the image-receiving layer may be prepared, for example, by replacing the image-receiving and decolorizing layers of the image-receiving elements of Examples 5 to 9 with an image-receiving layer coated at a coverage of about 550 mg./ft$^2$ (about 600 mg/m$^2$) of a mixture of (a) 1 part of a graft copolymer of 2.2 parts 4-vinyl pyridine and 1 part vinyl benzyl trimethyl ammonium chloride on 2.2 parts of hydroxyethyl cellulose, (b) 0.75 part of Igepal CO-890 and 0.25 part of a 1:1 copolymer of diacetone acrylamide and methacrylic acid. One may also include in the receiving layer about 5 mg./ft$^2$ (about 54 mg/m$^2$) of 1,4-butanediol diglycidyl ether as cross-linking agent. Use of such an image-receiving layer has been found to require only a few seconds longer to give a substantially white background.

In the test tube screening test discussed above, the amount of water present is sufficient to dissolve all of the polyoxyethylene polyoxypropylene block copolymer added, even at a 100:1 ratio. It is believed that the polyoxyalkylene decolorizing agent must be in solution to decolorize the phthalein dyes, and that one of the factors aiding in limiting the decolorization in the photographic process to the optical filter agent immediately adjacent the interface is that the amount of water available from the applied processing composition is too small to dissolve very much of the polyoxyalkylene polymer in the decolorizing layer.

It will be understood that the concentration of the decolorizing agent is such that in the absence of a pH neutralizing mechanism, such as the polymeric acid layer, the decolorizing agent is insufficient to discharge or "clear" all of the optical filter agent present. Thus, if the polymeric acid layer is omitted one observes that the optical filter agent adjacent the processing composition nterface is decolorized but the color of the optical filter agent reappears after a period of time, presumably due to later diffusing optical filter agent.

In lieu of using a polymeric acid layer adjacent the image-receiving layer as in the above examples, such a polymeric acid layer, or a second such polymeric acid layer, may be positioned adjacent the support carrying the photosensitive strata.

This invention is applicable to a wide variety of photographic processes as will be readily apparent to one skilled in the art. Dye developers are preferred image-providing substances, as indicated above, and constitute an example of initially diffusible image dye-providing substances. Other useful dye image-providing substances include initially diffusible dyes useful as image dyes per se and which couple with the oxidation product of a silver halide developing agent to provide a non-diffusible product, initially diffusible color couplers which couple with the oxidation product of a silverhalide developing agent to provide image dyes, initially non-diffusible compounds which react with the oxidation product of a silver halide developing agent, as by coupling or by cross-oxidation, to release a diffusible dye useful as an image dye per se. The final image may be formed as a result of the diffusion transfer of a soluble complex of undeveloped silver halide, in which event the image may be in silver as is well known. In another dye release system a soluble silver complex formed from undeveloped silver halide may be used to effect a cleavage reaction and release a dye or dye intermediate for transfer. Since these image-forming processes are well known and form no part per se of the present invention, it is not necessary to describe them in detail herein.

It will be understood that the transfer image may be positive or negative, with respect to the photographed subject matter, as a function of the particular image-forming system employed. The silver halide emulsion may be negative-working or positive-working (e.g., internal latent image) as appropriate for the particular imaging system.

For convenience, the disclosures of the aforementioned U.S. Pat. Nos. 3,415,644, 3,573,043 and 3,647,437 are expressly incorporated herein.

Since certain changes may be made in the above product and process without departing from the scope of the invention herein involved, the invention is not intended to be limited thereto but to include variations and modifications obvious to those skilled in the art and which are within the spirit of the invention and the scope of the appended claims.

What is claimed is:

1. A photographic process comprising providing a layer of a viscous aqueous alkaline processing composition between a first sheet-like element and a second sheet-like element; said first sheet-like element comprising an opaque support carrying an exposed silver halide emulsion; said second sheet-like element comprising a transparent support carrying an image-receiving layer; said processing composition comprising a light-reflecting pigment and at least one light-absorbing optical filter agent, said optical filter agent being a pH-sensitive dye; said application of said processing composition being effective to develop said exposed silver halide emulsion and to form a visible image in said image layer, the combination of said light-reflecting pigment and said optical filter agent being effective to prevent transmission through said processing composition layer of light actinic to said silver halide emulsion during development thereof; the layer of said second sheet-like element in contact with said processing composition layer containing a substantially nondiffusible decolorizing agent adapted to reduce, without pH reduction, the light-absorbing ability of said optical filter agent immediately adjacent the interface between said layer and said processing composition without reducing the light-absorbing ability of said optical filter agent within said processing composition, whereby the transmission density of said processing composition layer is substantially unchanged but the surface of said processing composition layer viewable through said transparent support appears substantially white substantially immediately after said processing composition is applied.

2. A photographic process as defined in claim 1 wherein said pH-sensitive dye is a phthalein dye.

3. A photographic process as defined in claim 1 wherein said decolorizing agent is in a layer over said image-receiving layer.

4. A photographic process as defined in claim 2 wherein the remaining optical filter agent is decolorized by reducing the pH after a predetermined time subsequent to the decolorization of the said optical filter agent adjacent said inferface.

5. A photographic process as defined in claim 1 wherein the concentrations of said optical filter agent and said light-reflecting pigment are effective to provide a transmission density of at least 6.

6. A photographic process as defined in claim 5 wherein the reflection density of said layer of processing composition has a reflection density not greater than about 1 in the absence of said decolorizing agent.

7. A photograhic process as defined in claim 6 wherein said reflection density is not greater than about 0.5 to 0.6 in the absence of said decolorizing agent.

8. A photographic process as defined in claim 1 wherein said optical filter agent is mordanted by gelatin, said first sheet-like element contains gelatin, and said second sheet-like element is free of gelatin.

9. A photographic process as defined in claim 1 wherein said decolorizing agent is present in a concentration effective to reduce the red reflection density of said layer of processing composition to not more than about 0.35 within 10 seconds after said processing composition is applied.

10. A photographic process as defined in claim 1 wherein said decolorizing agent is a polyoxyalkylene polymer.

11. A photographic process as defined in claim 10 wherein said polyoxyalkylene polymer is a polyoxyethylene polyoxypropylene block copolymer.

12. A photographic process as defined in claim 10 wherein said decolorizing agent is a nonylphenoxyethylene oxide ethanol.

13. A photographic process as defined in claim 1 wherein said decolorizing layer comprises a mixture of a polymeric decolorizing agent and a second polymer.

14. A photographic process as defined in claim 13 wherein said polymeric decolorizing agent is a polyoxyethylene polyoxypropylene block copolymer and said second polymer is polyvinyl alcohol.

15. A photographic process as defined in claim 1 wherein said optical filter agent contains a long chain substituent.

16. A photographic process as defined in claim 1 wherein said optical filter agent is a pH-sensitive phthalein dye containing a

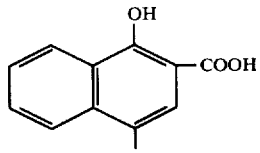

group and said decolorizing agent is a polyoxyalkylene copolymer.

17. A photographic process as defined in claim 1 wherein after a predetermined period subsequent to the decolorization of said optical filter agent adjacent said interface the pH of said processing composition layer is reduced to a pH effective to decolorize optical filter agent present in said layer, said pH reduction being effected by a neutralizing layer present in at least one of said sheet-like elements.

18. A photographic process as defined in claim 1 wherein said processing composition contains no more than about 1% by weight of a viscosity-providing polymer.

19. A photographic process as defined in claim 18 wherein said concentration of viscosity-providing polymer is about 0.8%.

20. A photographic process as defined in claim 18 wherein said viscosity-increasing polymer is a polymeric oxime.

21. A photographic process as defined in claim 18 wherein said viscosity-increasing polymer is hydroxyethyl cellulose.

22. A photographic process as defined in claim 1 wherein said visible image is a dye image.

23. A photographic process as defined in claim 22 wherein said dye is a dye developer.

24. A photographic process as defined in claim 1 wherein said decolorizing agent is a neutral polymeric material.

25. An image-receiving element, for use in a diffusion transfer process, comprising a transparent support carrying, in sequence and on the same side of said support, an image-receiving layer comprising a mordant for a diffusion transfer process image dye, and an outer layer comprising a polyoxyalkylene polymeric decolorizing agent for an optical filter agent, said optical filter agent being a pH-sensitive dye.

26. An image-receiving element as defined in claim 25, including a layer of a polymeric acid adjacent said support, and a polymeric timing layer between said image-receiving layer and said polymeric acid layer.

27. An image-receiving element as defined in claim 25 wherein said mordant is a quaternary ammonium polymer.

28. An image-receiving element as defined in claim 25 wherein said polyoxyalkylene polymer is a nonylphenoxyethylene oxide ethanol.

29. An image-receiving element as defined in claim 25 wherein said polyoxyalkylene polymer is a polyoxyethylene polyoxypropylene block copolymer.

30. An image-receiving element as defined in claim 25 wherein said polyoxyalkylene polymer is mixed with polyvinyl alcohol.

31. A diffusion transfer process film unit including a first sheet-like element and a second sheet-like element, said first sheet-like element comprising an opaque support carrying a silver halide emulsion, said second sheet-like element comprising an image-receiving layer carried on a transparent support, said transparent support and the layers between it and said silver halide emulsion being transparent to radiation actinic to said silver halide emulsion; a viscous aqueous alkaline processing composition releasably contained in a rupturable container positioned to release said composition for distribution between said first and second sheet-like elements with said supports outermost, said processing composition including a light-reflecting pigment in a concentration effective to mask said photosensitive layer when said image-receiving layer is viewed through said transparent support; said processing composition also including an optical filter agent, said optical filter agent being a pH-sensitive dye which is light-absorbing at the pH of said processing composition, said optical filter agent being present in a concentration effective in combination with said pigment to provide a transmission density when distributed between said sheet-like elements and effective to substantially prevent further exposure of said silver halide emulsion during the performance of the transfer process in an area of light actinic to said silver halide emulsion; said first sheet-like element including an image-providing material adapted to provide an image-forming material diffusible to said image-receiving layer as a function of said development, the layer of said second sheet-like element positioned to be in direct contact with said processing composition following distribution thereof containing a substantially nondiffusible agent adapted to decolorize said optical filter agent without pH reduction, the concentration of said decolorizing agent being effective to decolorize optical filter agent immediately adjacent the interface between said processing composition and said decolorizing layer without substantially decreasing said transmission density, whereby the surface of said processing composition layer viewable through said transparent support appears substantially white substantially immediately after said processing composition is distributed.

32. A film unit as defined in claim 31, including a layer positioned in at least one of said sheet-like elements adapted after a predetermined time after said processing composition is distributed to provide an acid in a quantity effective to reduce the pH of said processing composition layer to a second pH at which said image-forming component is substantially non-diffusible.

33. A film unit as defined in claim 32 wherein said second pH is below the pKa of said optical filter agent.

34. A film unit as defined in claim 30 wherein the light-reflecting pigment is titanium dioxide.

35. A film unit as defined in claim 31 wherein the optical filter agent comprises a phthalein pH-sensitive dye possessing a pKa below the first pH and above the second pH.

36. A film unit as defined in claim 31 wherein said decolorizing agent is in a layer over said image-receiving layer.

37. A film unit as defined in claim 31 wherein said decolorizing agent is a neutral polymer.

38. A film unit as defined in claim 31 wherein said decolorizing agent is in said image-receiving layer.

39. A film unit as defined in claim 35 wherein the pH-sensitive dye is substantially nondiffusible from the layer of processing composition to the image-receiving layer.

40. A film unit as defined in claim 31 wherein said diffusible image-forming material is a dye.

41. A film unit as defined in claim 40 wherein said dye is a dye developer.

42. A film unit as defined in claim 31 wherein said diffusible image-forming material is a silver complex capable of forming a silver image in said image-receiving layer.

43. A film unit as defined in claim 32 wherein said acid providing layer is a layer of a polymeric acid.

44. A film unit as defined in claim 43 wherein a polymeric acid layer is positioned between said transparent support and said image-receiving layer.

45. A film unit as defined in claim 43 wherein a polymeric acid layer is positioned in said first sheet-like element adjacent said opaque support.

46. A film unit as defined in claim 31 wherein said decolorizing layer is adapted to reduce the red reflection density of said light-reflecting pigment layer to not greater than about 0.35 within ten seconds after said processing composition is applied.

47. A film unit as defined in claim 46 wherein the reflection density of said light-reflecting pigment layer is about 0.5 to 0.6 in the absence of said decolorizing agent.

48. A film unit as defined in claim 31 wherein said pH-sensitive dye is a phthalein dye.

49. A film unit as defined in claim 31 wherein the remaining optical filter agent is decolorized by reducing the pH after a predeterined time subsequent to the decolorization of the said optical filter agent adjacent said interface.

50. A film unit as defined in claim 31 wherein the concentrations of said optical filter agent and said light-reflecting pigment are effective to provide a transmission density of at least 6.

51. A film unit as defined in claim 31 wherein said optical filter agent is mordanted by gelatin, said first sheet-like element contains gelatin, and said second sheet-like element is free of gelatin.

52. A film unit as defined in claim 31 wherein said decolorizing agent is present in a concentration effective to reduce the red reflection density of said layer of processing composition to not more than about 0.35 within 10 seconds after said processing composition is applied.

53. A film unit as defined in claim 31 wherein said decolorizing agent is a polyoxyalkylene polymer.

54. A film unit as defined in claim 53 wherein said polyoxyalkylene polymer is a polyoxyethylene polyoxypropylene block copolymer.

55. A film unit as defined in claim 53 wherein said decolorizing agent is a nonylphenoxyethylene oxide ethanol.

56. A film unit as defined in claim 36 wherein said decolorizing layer over said image-receiving layer comprises a mixture of a polymeric neutral decolorizing agent and a second polymer.

57. A film unit as defined in claim 56 wherein said polymeric decolorizing agent is a polyoxyethylene polyoxypropylene block copolymer and said second polymer is polyvinyl alcohol.

58. A film unit as defined in claim 31 wherein said optical filter agent contains a long chain substituent.

59. A film unit as defined in claim 31 wherein said optical filter agent is a pH-sensitive phthalein dye containing a

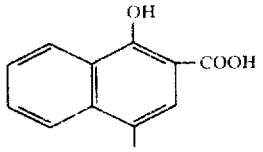

group and said decolorizing agent is a polymer.

60. A film unit as defined in claim 31 wherein said processing composition contains no more than about 1% by weight of a viscosity-providing polymer.

61. A film unit as defined in claim 60 wherein said concentration of viscosity-providing polymer is about 0.8%.

62. A film unit as defined in claim 60 wherein said viscosity-increasing polymer is a polymeric oxime.

63. A film unit as defined in claim 60 wherein said viscosity-increasing polymer is hydroxyethyl cellulose.

64. A film unit as defined in claim 31 wherein said optical filter agent is a pH-sensitive dye and said decolorizing agent is a polymeric acid.

65. A film unit as defined in claim 44 wherein said layer of a polymeric acid is adjaent said support, and including a polymeric timing layer between said image-receiving layer and said polymeric acid layer.

66. A film unit as defined in claim 51 wherein said image-receiving layer includes a quaternary ammonium polymeric mordant.

67. A film unit as defined in claim 31 wherein said decolorizing agent is a poly-N-vinyl pyrrolidone.

68. A film unit as defined in claim 31 wherein said first sheet-like element includes a blue-sensitive silver halide emulsion, a green-sensitive halide emulsion, and a red-sensitive silver halide emulsion, said silver halide emulsions having associated therewith, respectively, a yellow dye developer, a magenta dye developer and a cyan dye developer.

69. A photographic process comprising providing a layer of a viscous aqueous alkaline processing composition between a first sheet-like element and a second sheet-like element; said first sheet-like element comprising an opaque support carrying an exposed silver halide emulsion; said second sheet-like element comprising a transparent support carrying an image layer; said processing composition comprising a light-reflecting pigment and at least one light-absorbing optical filter agent, said optical filter agent being a pH-sensitive dye; said application of said processing composition being effective to develop said exposed silver halide emulsion and to form a visible image in said image layer, the combination of said light-reflecting pigment and said optical filter agent being effective to prevent transmission through said processing composition layer of light actinic to said silver halide emulsion during development thereof; said second sheet-like element including a substantially non-diffusible decolorizing agent in a layer in contact with said processing composition layer, said decolorizing agent being adapted to reduce, without pH reduction, the light-absorbing ability of said optical filter agent immediately adjacent the interface between said layer and said processing composition layer without reducing the light-absorbing ability of said optical filter agent not adjacent said interface, said decolorizing agent forming a complex with said pH-sensitive dye adjacent said interface which complex exhibits a pKa higher than said pH-sensitive dye in said processing composition, whereby the transmission density of said processing composition layer is substantially unchanged but the surface of said processing composition layer viewable through said transparent support appears substantially white substantially immediately after said processing composition is applied.

* * * * *